US008753143B2

(12) United States Patent
Su et al.

(10) Patent No.: US 8,753,143 B2
(45) Date of Patent: Jun. 17, 2014

(54) CONNECTION STRUCTURE FOR FLEXIBLE CIRCUIT CABLE

(71) Applicant: Advanced Flexible Circuits Co., Ltd., Taoyuan County (TW)

(72) Inventors: Kuo-Fu Su, Taoyuan County (TW); Gwun-Jin Lin, Taoyuan County (TW); Chih-Heng Chuo, Taoyuan County (TW)

(73) Assignee: Advanced Flexible Circuits Co., Ltd., Taoyuan County (TW)

( * ) Notice: Subject to any disclaimer, the term of this patent is extended or adjusted under 35 U.S.C. 154(b) by 58 days.

(21) Appl. No.: 13/649,184

(22) Filed: Oct. 11, 2012

(65) Prior Publication Data

US 2014/0057482 A1 Feb. 27, 2014

(30) Foreign Application Priority Data

Aug. 21, 2012 (TW) ..... 101130324 A

(51) Int. Cl.
*H01R 12/00* (2006.01)

(52) U.S. Cl.
USPC ..... 439/492

(58) Field of Classification Search
USPC ..... 439/492, 493, 499
See application file for complete search history.

(56) References Cited

U.S. PATENT DOCUMENTS

| | | | | |
|---|---|---|---|---|
| 3,573,345 | A * | 4/1971 | Devries et al. | 174/254 |
| 4,168,876 | A * | 9/1979 | Balde | 439/499 |
| 4,547,028 | A * | 10/1985 | Morgan et al. | 439/108 |
| 4,679,868 | A * | 7/1987 | Hasircoglu | 439/495 |
| 4,871,319 | A * | 10/1989 | Babow | 439/77 |
| 5,580,271 | A * | 12/1996 | Buchheister et al. | 439/493 |
| 6,695,641 | B1 * | 2/2004 | Lee | 439/493 |
| 8,052,464 | B2 * | 11/2011 | Maruishi et al. | 439/496 |
| 2002/0022398 | A1 * | 2/2002 | Okano | 439/492 |
| 2002/0173191 | A1 * | 11/2002 | I-Tse | 439/329 |
| 2003/0181095 | A1 * | 9/2003 | Wang et al. | 439/492 |

* cited by examiner

*Primary Examiner* — Gary Paumen
(74) *Attorney, Agent, or Firm* — Rosenberg, Klein & Lee

(57) ABSTRACT

A connection structure for a flexible circuit cable includes a flexible circuit cable that has a flexible circuit substrate having a first end bonded to a soldering stage of the connector housing with first finger pad conductive contacts of conductive lines of the flexible circuit cable respectively corresponding to cable soldering sections of metal conductive terminals of the connector. A soldering layer is formed between a metal coating layer of the first finger pad conductive contact of each of the conductive lines and the cable soldering section of the corresponding metal conductive terminals to set the conductive lines of the flexible circuit cable in electrical connection with the metal conductive terminals of the connector.

17 Claims, 12 Drawing Sheets

CONNECTION STRUCTURE FOR FLEXIBLE CIRCUIT CABLE

BACKGROUND OF THE INVENTION

1. Field of the Invention

The present invention relates to the design of structure of signal transmission circiuit cable, and in particular to an insertion connection structure for a flexible circuit cable.

2. The Related Arts

Connectors are commonly used in circuit arrangements of various electronic devices, such as computer devices, mobile phones, digital cameras, GPS, LCD panels, inspection devices, and control devices, to connect signal lines, coaxial cables, or connection flat cables to circuit boards, circuit modules, or electrical devices for transmission of electrical signals.

A connector is a connection device that electrically connects an electrical wire, a circuit board, and other electrical components and provides a function of separable interface for connection two sub-systems of an electronic system to effect transmission of signal or power. Generally, a connector is soldered on a circuit board in such a way that terminals of the connection are put in engagement with contacts of circuit lay outs on the circuit board to form electrical connection. In some applications, a connector may be used to retain another circuit component, such as retaining a flexible circuit cable. Thus, a connection interfaces between a flexible circuit cable and a circuit board for transfer of electrical signals.

However, connection between the connectors and flexible circuit cable is mostly done by directly inserting or plugging the flexible circuit cable into an insertion opening of the connector. This results in poor connection that affects transmission of signals. Further, the flexible circuit cable is generally a circuit like flat cable that is generally deflectable. When the flexible circuit cable is acted upon by an external force and is thus deflected, the flexible circuit cable may get detached.

To handle the technical issue of the known devices, a zero insertion force structure is available for connectors, in which the zero insertion force structure fixes an insertion end of a flexible circuit cable to reinforce the connection between the flexible circuit cable and the connector, protecting the flexible circuit cable from being deflected as being acted upon by an external force and thus preventing the flexible circuit cable from undesirably detached to affect transmission of signal. However, such a technique makes the connector structure complicated and manufacturing cost increased.

SUMMARY OF THE INVENTION

Thus, in view of the deficiencies of the known techniques, an object of the present invention is to provide a connection structure of flexible circuit cable, which uses a soldering layer to bond a flexible circuit cable to cable soldering sections of a connector so as to fix the flexible circuit cable to the connector to improve the deficiencies of the use of the conventional connectors.

Another object of the present invention is to provide a circuit designer with diversified solutions for circuit lay out and arrangement of spaces by following the present invention to divide a flexible circuit cable into individual bundling sections so that the amount of spaced needed for the flexible circuit cable to pass through a hinge is reduced, making the designing of the hinge structure more flexible.

Each individual bundling section occupies a less amount of space on a circuit board as compared to the conventional flat cable bundling techniques to be laid on a circuit board according to the need of a designer, making it possible to reduce the thickness of the circuit board and allowing the design of electronic device toward being light-weighted and compact.

To achieve the above objects, the present invention provides a connection structure of flexible circuit cable, which comprises a connector, which comprises a connector housing and a plurality of metal conductive terminals, and a flexible circuit cable.

The connector housing comprises an insertion port and a flexible circuit cable connection port corresponding to the insertion port and forms a soldering stage at the flexible circuit cable connection port.

The plurality of metal conductive terminals is arranged on the soldering stage of the flexible circuit cable connection port of the connector housing to be spaced from each other by a predetermined spacing distance. Each of the metal conductive terminals comprises a connection section, which extends through the connector housing; a cable soldering section, which extends from an end of the connection section to be located on the soldering stage of the flexible circuit cable connection port of the connector housing; and an insertion section, which extends from an opposite end of the connection section to be located on the insertion port of the connector housing.

The flexible circuit cable comprises a flexible circuit substrate, which extends in an extension direction and comprises a first end and a second end; a plurality of parallel conductive lines, which is arranged on the flexible circuit substrate in the extension direction and extends to the first end of the flexible circuit substrate to form a plurality of first finger pad conductive contacts; an insulation layer, which is formed on the flexible circuit substrate to cover the conductive lines with each of the first finger pad conductive contacts exposed outside surfaces of the conductive lines; and a metal coating layer, which is formed on at least a portion of a surface of each of the first finger pad conductive contacts.

When the first end of the flexible circuit substrate of the flexible circuit cable is bonded to the soldering stage of the connector housing, the first finger pad conductive contacts of the flexible circuit cable are set to respectively correspond to the cable soldering sections of the metal conductive terminals with a soldering layer formed between the metal coating layer of each of the first finger pad conductive contacts and the cable soldering section of the corresponding one of the metal conductive terminals to have the conductive lines of the flexible circuit cable set in electrical connection with the metal conductive terminals of the connector. The soldering layer is selected from a group consisting of solder paste and conductive adhesive.

A shielding layer is formed on at least a surface of the circuit cable and the shielding layer comprises at least one opening structure. To facilitate passage of the flexible circuit cable through a narrow hole or a bore of a hinge, a plurality of slit lines can be formed along gaps between the conductive lines to allow of folding or bundling of the cable so that a stand flexible circuit cable can be put through a narrow hole or a bore of a hinge.

Finger pad conductive contacts arranged on the first end and the second end of the flexible circuit cable according to the present invention can be identical or different and the width and contact pitch can also be made identical or different to suit the needs of various applications. Further, the flexible circuit cable may be additionally connected to an extension circuit cable. The extension circuit cable can also be cut to form slit lines and comprises a bundling structure to facilitate passages of the extension flat cable through a bore of a hinge or a narrow hole.

The technical solution adopted in the present invention uses a soldering layer to bond a flexible circuit cable to a cable soldering section of a connector so as to fix the flexible circuit cable to the connector, preventing signal transmission from being affected by the flexible circuit cable being not securely connected to the connector to thereby improving the deficiencies found in the use of the conventional connectors. Further, compared to the conventional connector that includes a zero insertion force structure, the insertion connection structure of flexible circuit cable provided by the present invention is simple and reduces the manufacture cost.

BRIEF DESCRIPTION OF THE DRAWINGS

The present invention will be apparent to those skilled in the art by reading the following description of preferred embodiments of the present invention, with reference to the attached drawings, in which.

DETAILED DESCRIPTION OF THE PREFERRED EMBODIMENTS

Figure 1:
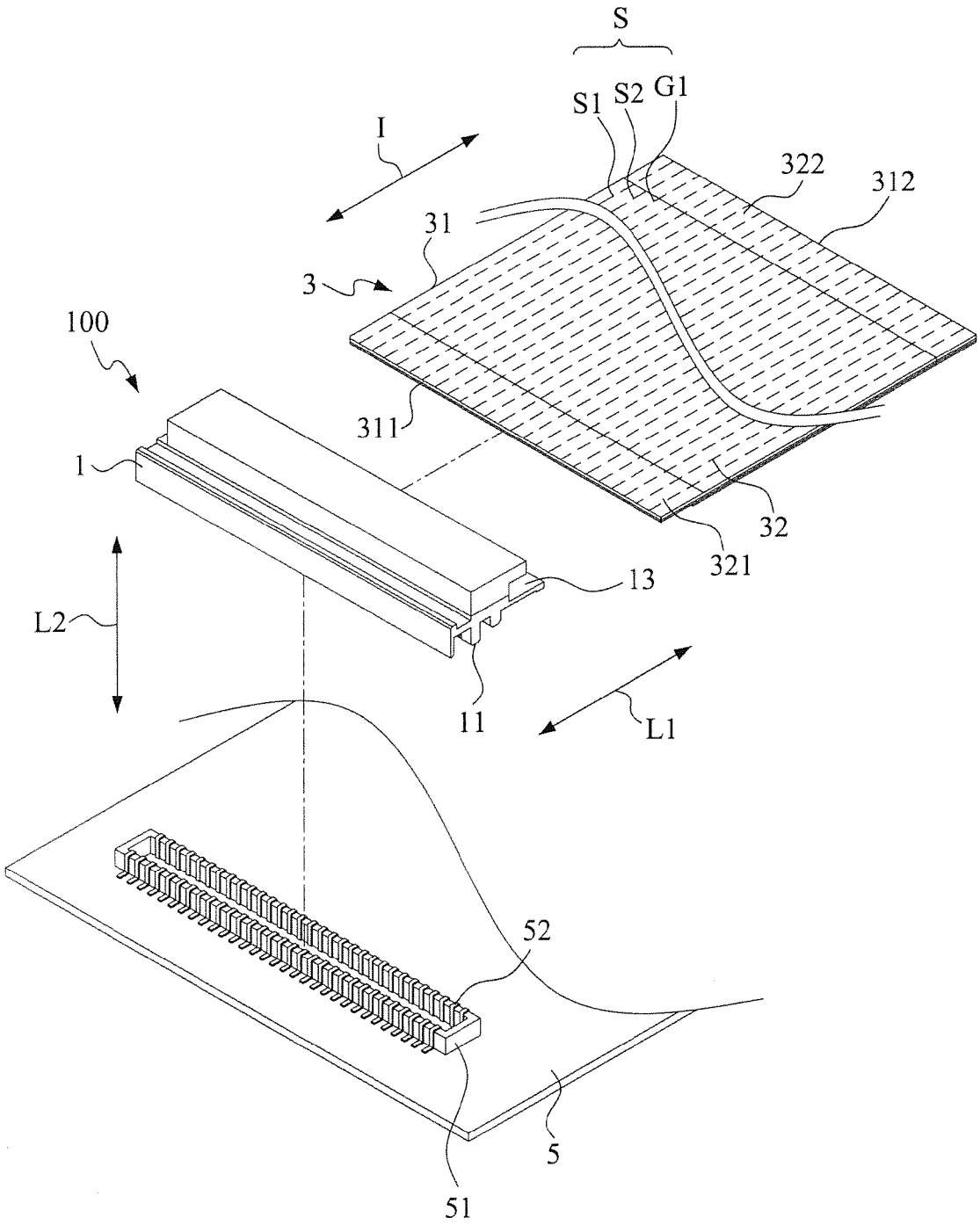
FIG. 1 is a perspective view showing a flexible circuit cable and a connector in accordance with a first embodiment of the present invention in a detached condition.
Figure 2:
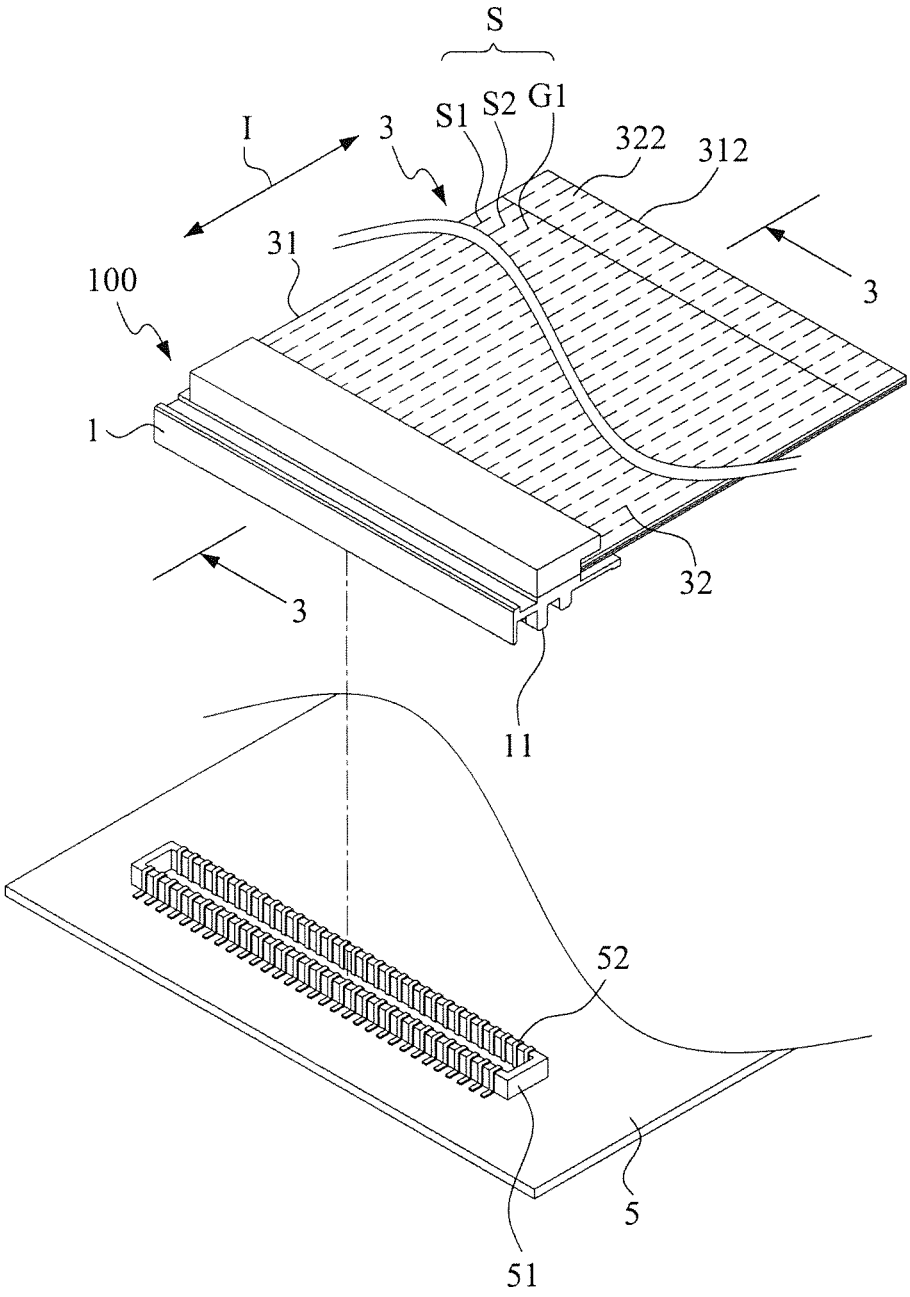
FIG. 2 is perspective view showing the flexible circuit cable and the connector in accordance with the first embodiment of the present invention in an assembled condition.
Figure 3:
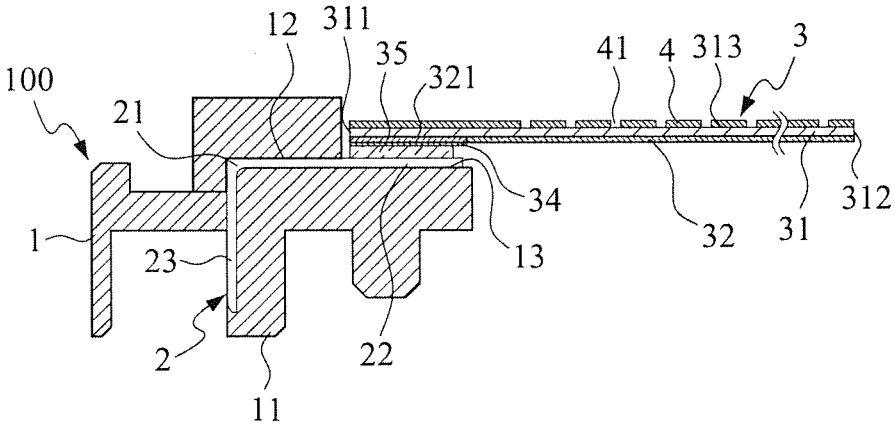
FIG. 3 is a cross-sectional view taken along line 3-3 of FIG. 2.
Figure 4:
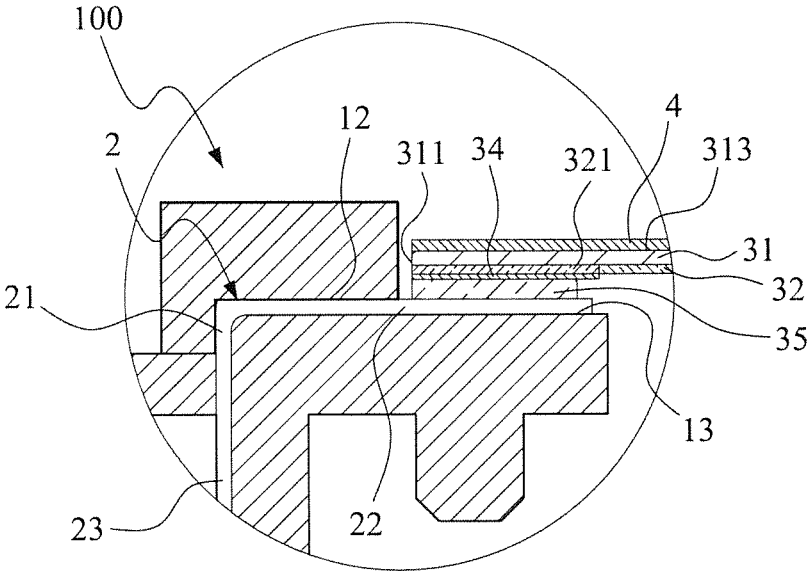
FIG. 4 is an enlarged sectional view of a portion of the first embodiment of the present invention.
Figure 5:
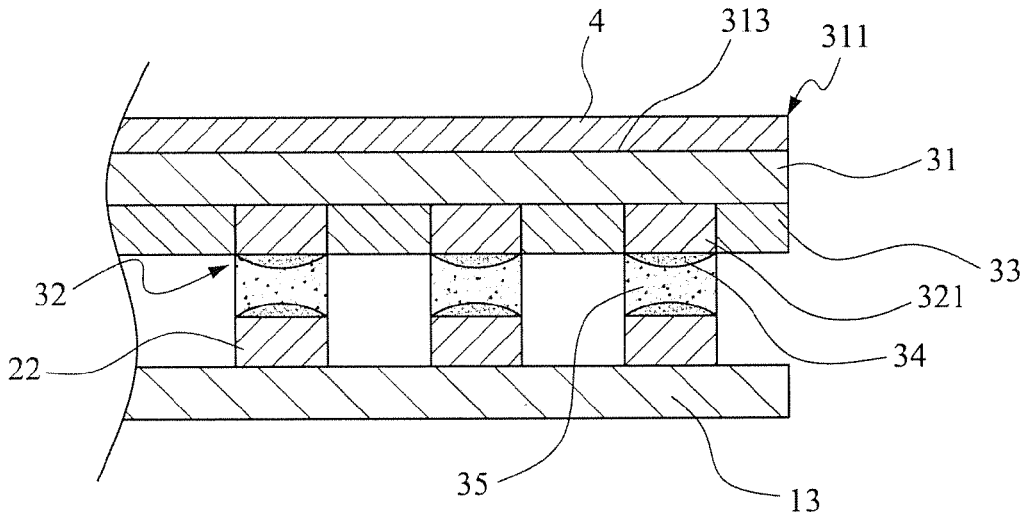
FIG. 5 is a schematic view illustrating bonding between a cable soldering section of a flat cable in accordance with the present invention and first finger pad conductive contacts of a flexible circuit cable.
Figure 6:
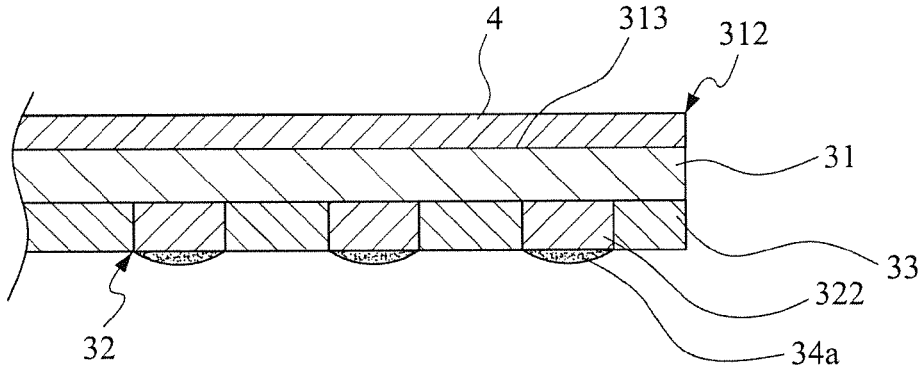
FIG. 6 is an enlarged sectional view of a portion of a second end of a flexible circuit substrate in accordance with the present invention.

With reference to the drawings and in particular to FIGS. 1-6, FIG. 1 is a perspective view showing a flexible circuit cable and a connector in accordance with a first embodiment of the present invention in a detached condition; FIG. 2 is perspective view showing the flexible circuit cable and the connector in accordance with the first embodiment of the present invention in an assembled condition; FIG. 3 is a cross-sectional view taken along line 3-3 of FIG. 2; FIG. 4 is an enlarged sectional view of a portion of the first embodiment of the present invention; FIG. 5 is a schematic view illustrating bonding between a cable soldering section of a flat cable in accordance with the present invention and first finger pad conductive contacts of a flexible circuit cable; and FIG. 6 is an enlarged sectional view of a portion of a second end of a flexible circuit substrate in accordance with the present invention. As shown in the drawings, the present invention provides a connection structure of flexible circuit cable, which comprises a connector 100 that comprises a connector housing 1 and a plurality of metal conductive terminals 2 and a flexible circuit cable 3.

The connector housing 1 comprises an insertion port 11 and a flexible circuit cable connection port 12 corresponding to the insertion port 11. The flexible circuit cable connection port 12 forms a soldering stage 13. The soldering stage 13 of the connector housing 1 is formed on the flexible circuit cable connection port 12 of the connector housing 1 to extend in a horizontal direction L1 and the insertion port 11 is formed on the connector housing 1 in a vertical direction L2.

The plurality of metal conductive terminals 2 is arranged on the soldering stage 13 of the flexible circuit cable connection port 12 of the connector housing 1 to be spaced from each other by a predetermined spacing distance. Each of the metal conductive terminals comprises a connection section 21, which extends through the connector housing 1; a cable soldering section 22, which extends from an end of the connection section 21 to be located on the soldering stage 13 of the flexible circuit cable connection port 12 of the connector housing 1; and an insertion section 23, which extends from an opposite end of the connection section 21 to the insertion port 11 of the connector housing 1.

The insertion port 11 of the connector housing 1 is insertable into an insertion receptacle 51 that is mounted to a circuit substrate 5 to allow the insertion sections 23 of the metal conductive terminals 2 to respectively engage signal terminals 52 arranged inside the insertion receptacle 51 to establish electrical connection therebetween for transmission of electrical signal transmitted through the flexible circuit cable 3 through the insertion sections 23 of the metal conductive terminals 2 to the circuit substrate 5.

The flexible circuit cable 3 comprises a flexible circuit substrate 31 extending in an extension direction I and comprising a first end 311 and a second end 312; a plurality of parallel conductive lines 32 arranged in the extension direction I on the flexible circuit substrate 31 and extending to the first end 311 of the flexible circuit substrate 31 to form a plurality of first finger pad conductive contacts 321; an insulation layer 33 formed on the flexible circuit substrate 31 and covering the conductive lines 32 but not covering surfaces of the first finger pad conductive contacts 321; and a first metal coating layer 34 formed on at least a portion of the surface of each of the first finger pad conductive contacts 321. The first metal coating layer 34 can be made of a material selected from a group including gold, silver, and copper. The plurality of parallel conductive lines 32 of the flexible circuit cable 3 comprises at least a group of differential mode signal lines S for transmitting differential mode signals. The differential mode signal lines S comprise a first differential mode signal line S1, a second differential mode signal line S2, and a grounding line G1.

The conductive lines 32 extend in the extension direction I to the second end 312 of the flexible circuit substrate 31 to form finger pad structures in a conventional form. In other words, the second end 312 forms a plurality of second finger pad conductive contacts 322 and the insulation layer 33 discussed above does not cover surfaces of the second finger pad conductive contacts 322. A second metal coating layer 34*a* is formed on at least a portion of the surface of each second finger pad conductive contact 322 of the conductive lines 3 (see FIG. 6). The second metal coating layer 34*a* can be made of a material selected from a group including gold, silver, and copper.

The upper surface 313 of the flexible circuit cable 3 is provided with a shielding layer 4. The shielding layer 4 comprises at least one opening structure 41 (see FIG. 3), whereby through selection of the size, location, and distribution of the opening structure 41, impedance control can be realized for the conductive lines 32.

When the first end 311 of the flexible circuit substrate 31 of the flexible circuit cable 3 is bonded to the soldering stage 13 of the connector housing 1, the first finger pad conductive contacts 321 of the flexible circuit cable 3 are set to correspond to the cable soldering sections 22 of the metal conductive terminals 2 one by one with a soldering layer 35 provided between the first metal coating layer 34 of each of the first finger pad conductive contacts 321 and the cable soldering section 22 of the corresponding metal conductive terminal 2, whereby the conductive lines 32 of the flexible circuit cable 3 can be set in electrical connection with the metal conductive terminals 2 of the connector 100 through the first finger pad conductive contacts 321. The soldering layer can be either solder paste or conductive grease. The soldering or bonding operation is carried out at a temperature between 120° C. and 180° C. Depending upon the heat resistance temperature of the insulation material used for the connector housing 1, the soldering or bonding operation can be carried out at other suitable temperatures that may be a higher temperature.

Figure 7:
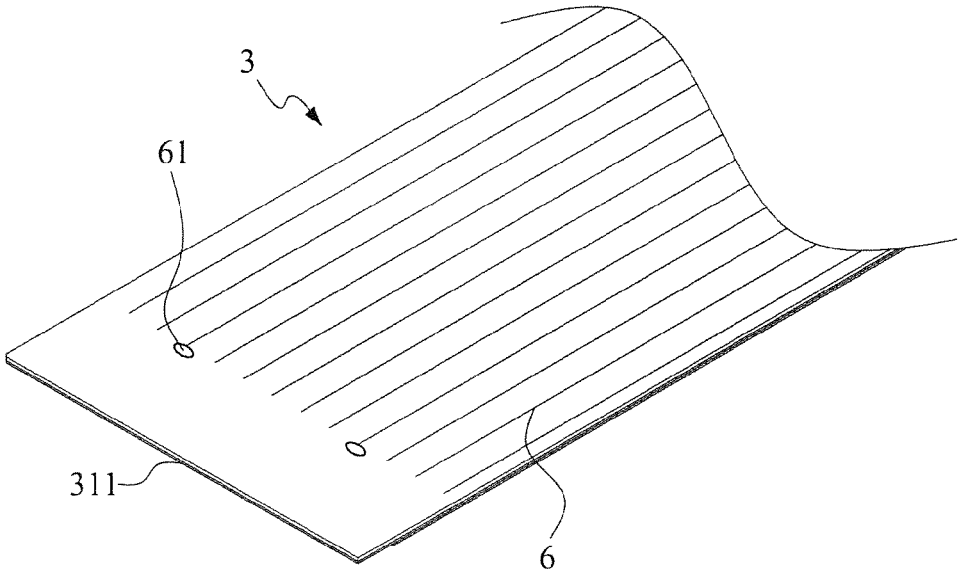
FIG. 7 is a schematic view illustrating a plurality of slit lines formed in the flexible circuit cable according to the present invention.
Figure 8:
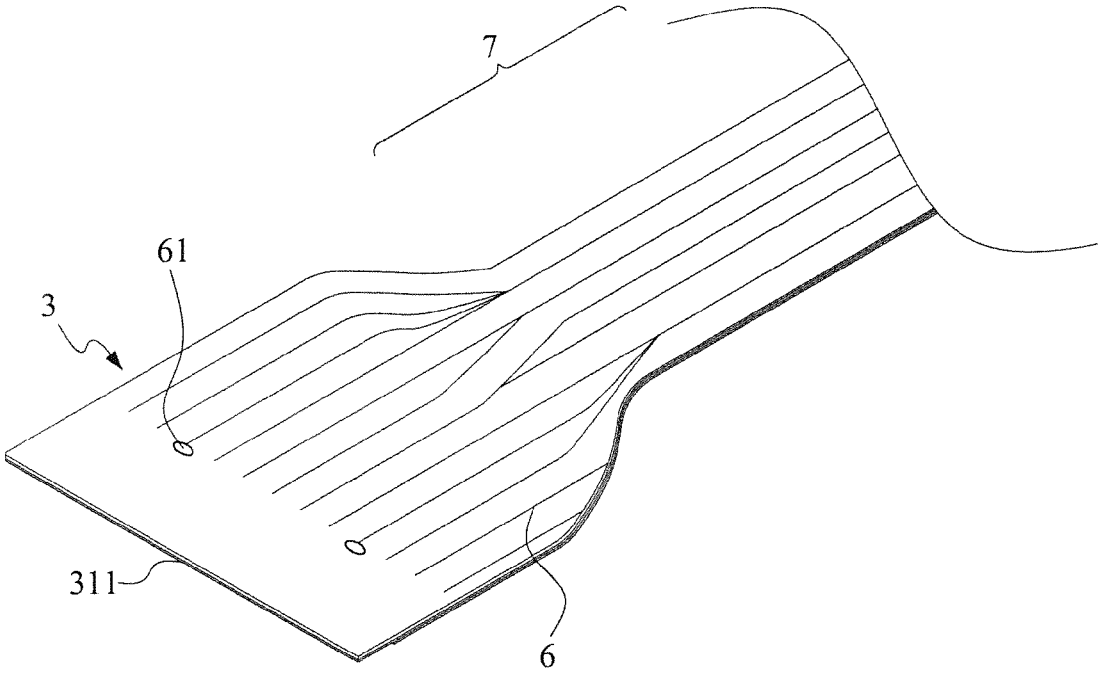
FIG. 8 is a schematic view illustrating the flexible circuit cable is folded after slitting.
Figure 9:
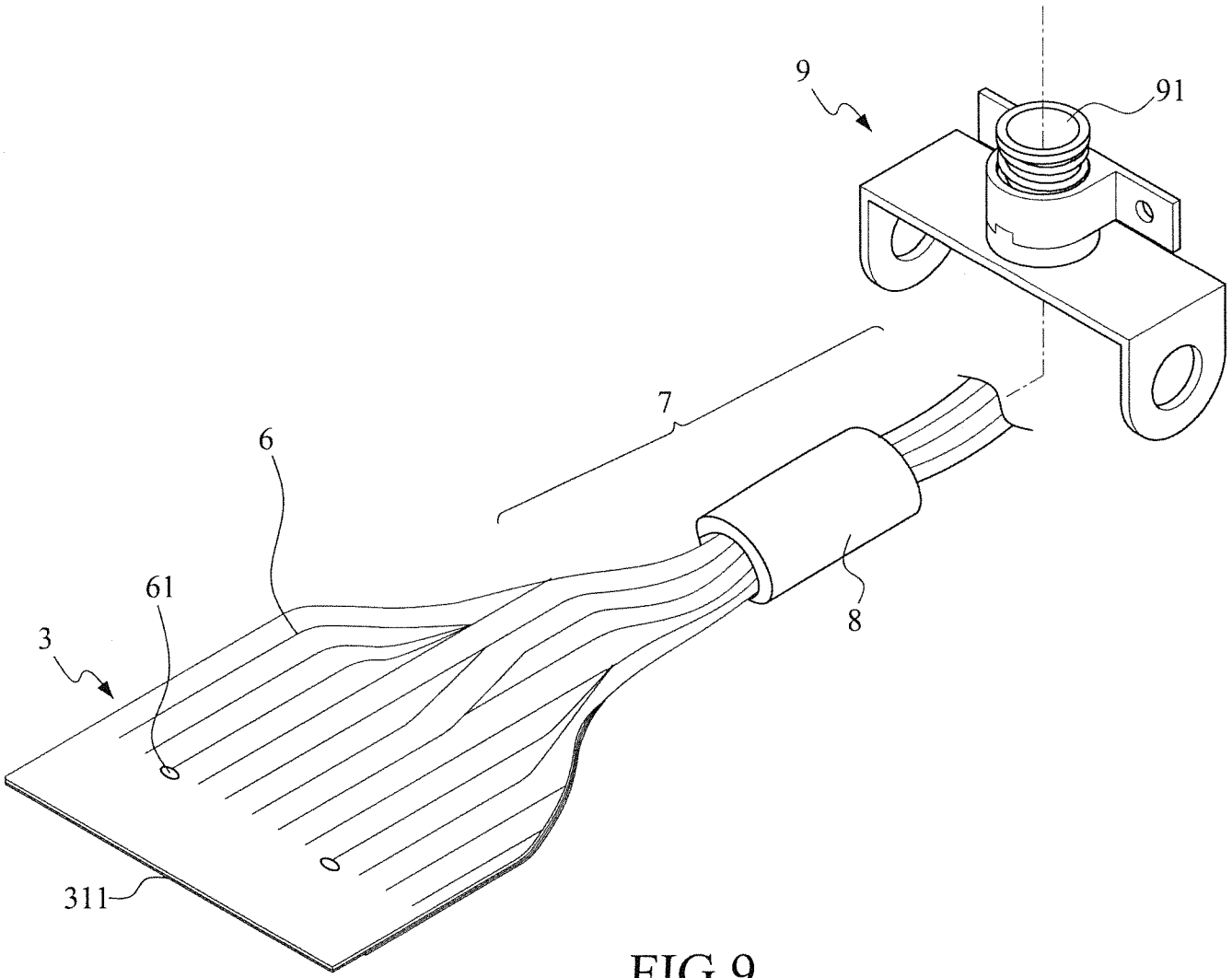
FIG. 9 is a schematic view illustrating the flexible circuit cable is wrapped after slitting.

Referring to FIGS. 7-9, FIG. 7 is a schematic view illustrating a plurality of slit lines formed in the flexible circuit cable according to the present invention; FIG. 8 is a schematic view illustrating the flexible circuit cable is folded after slitting; and FIG. 9 is a schematic view illustrating the flexible circuit cable is wrapped after slitting. As shown in the drawings, the flexible circuit cable 3 is slit along gaps between the conductive lines 32 to form a plurality of slit lines 6, which divides the plurality of conductive lines into a plurality of individual conductive line units. At least one tear protection hole 61 is formed an end of the slit line 6. The tear protection hole 61 functions to prevent tearing of the flexible circuit cable 3.

The flexible circuit cable 3 comprises at least one bundling section 7 (as shown in FIG. 8) and a wrapping member 8 is applied to bundle the bundling section 7 together (as shown in FIG. 9) in order to reduce surface area of extension section. This improves flexibility of circuit board design and also allows of passage through a bore 91 of a hinge 9 or a narrow hole (not shown). The wrapping member is made of a material selected from insulation material, conductive fabric, or electromagnetic shielding material.

Figure 10:
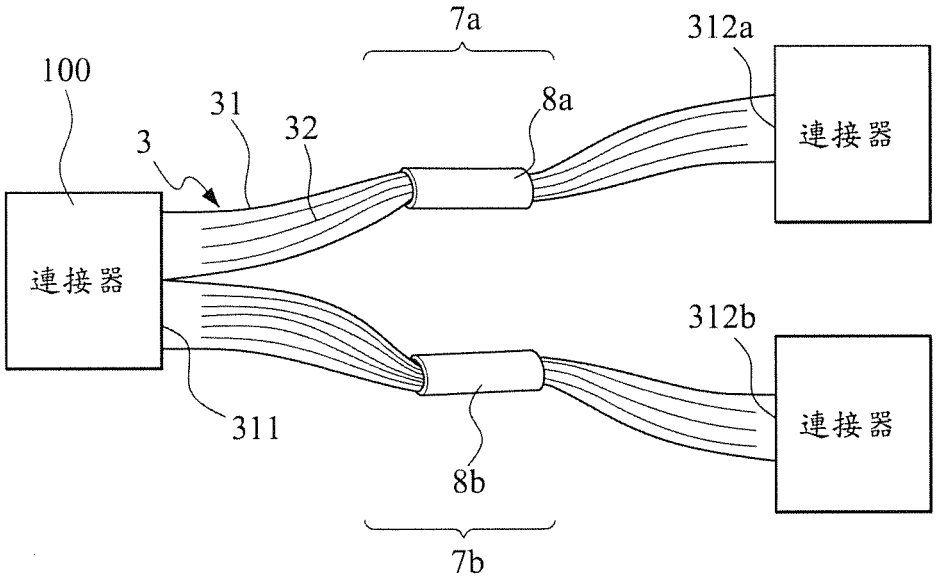
FIG. 10 is a schematic view showing a second embodiment according to the present invention.
Figure 11:
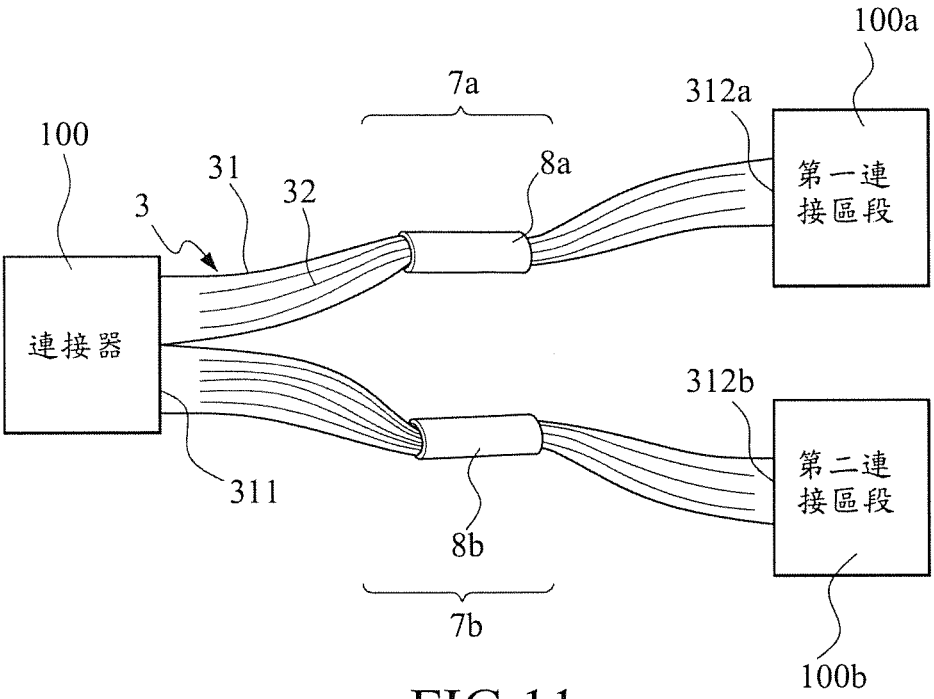
FIG. 11 is a schematic view showing a third embodiment according to the present invention.

Referring to FIGS. 10 and 11, FIG. 10 is a schematic view showing a second embodiment according to the present invention and FIG. 11 is a schematic view showing a third embodiment according to the present invention. The flexible circuit cable 3 may comprise two independent bundling sections 7*a*, 7*b* and wrapping members 8*a*, 8*b* are provided to individually bundle the bundling sections 7*a*, 7*b*. The flexible circuit substrate has second ends 312*a*, 312*b* that are each coupled to a connector 100 (as shown in FIG. 10). Further, the second ends 312*a*, 312*b* of the flexible circuit substrate respectively form a first connection zone A and a second connection zone B. The first connection zone A and the second connection zone B can be arranged as an insertion terminal, an insertion receptacle, a soldering terminal, an open terminal, a circuit adaption board, or a component mounting zone, depending upon practical applications.

Figure 12:
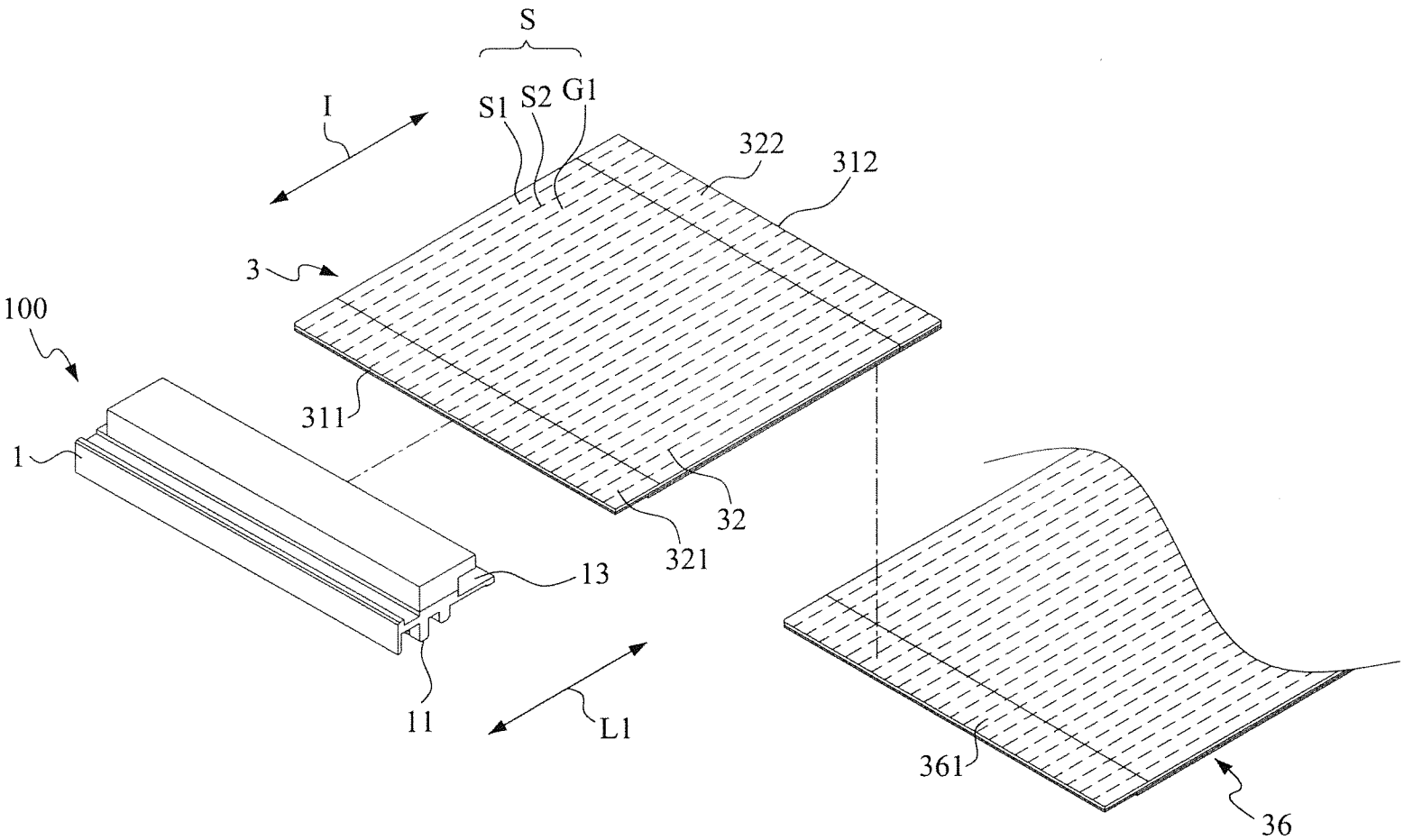
FIG. 12 is a perspective view showing a fourth embodiment according to the present invention.
Figure 13:
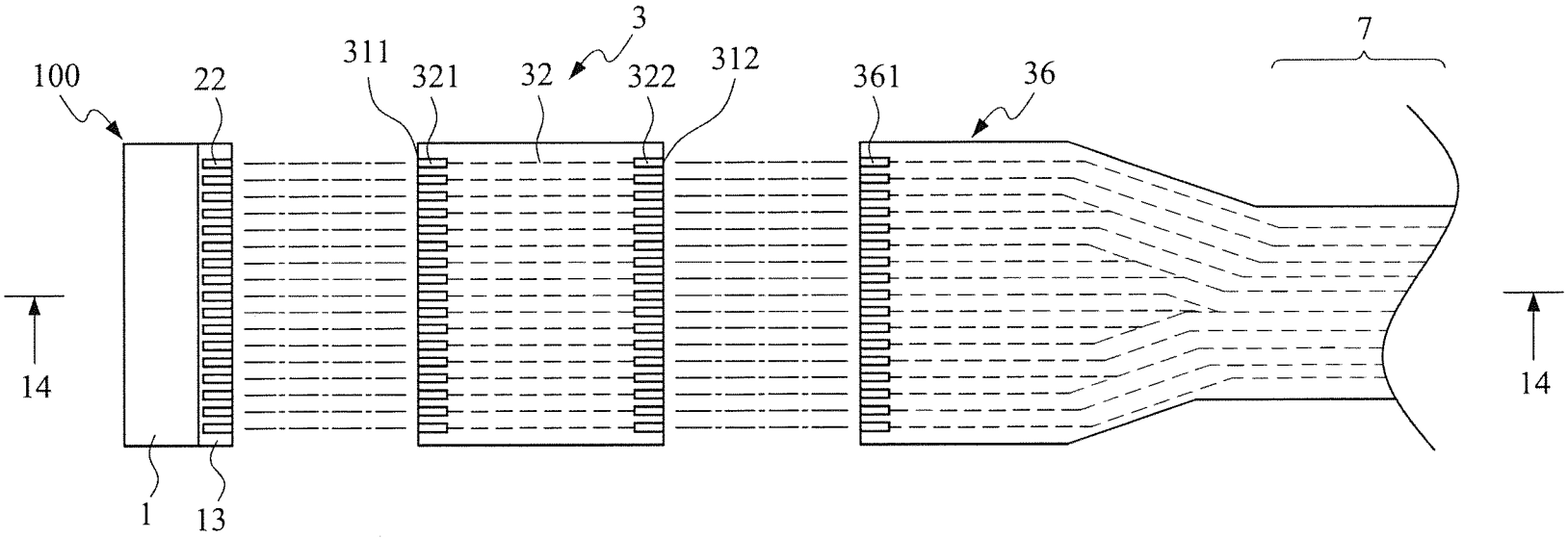
FIG. 13 is a plan view of the embodiment of FIG. 12.
Figure 14:
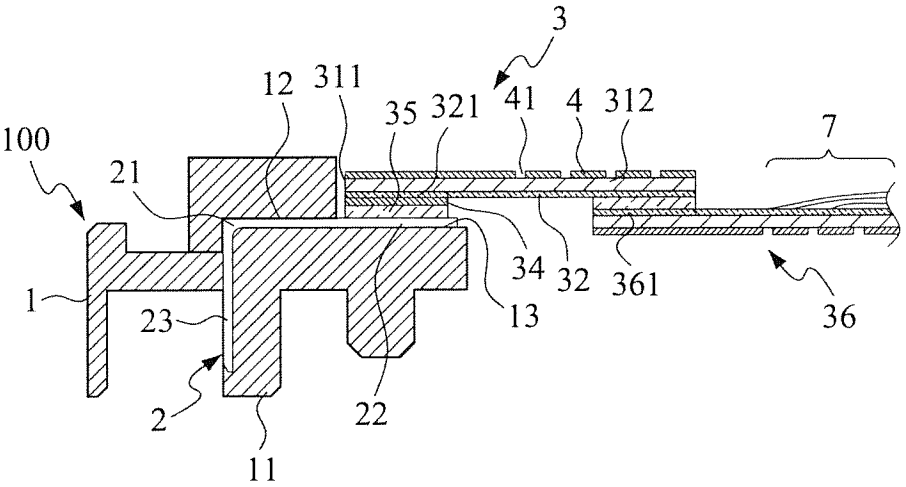
FIG. 14 is a cross-sectional view taken along line 14-14 of FIG. 13.

Referring to FIGS. 12-14, FIG. 12 is a perspective view showing a fourth embodiment according to the present invention; FIG. 13 is a plan view of the embodiment of FIG. 12; and FIG. 14 is a cross-sectional view taken along line 14-14 of FIG. 13. In the instant embodiment, most of the structure is identical to that of the first embodiment shown in FIG. 1 and similar components are labeled with like reference numerals. A difference is that the second end 312 of the flexible circuit cable 3 is connected to an extension circuit cable 36. The extension circuit cable 36 has an end forming a plurality of cable contacts 361. The second finger pad conductive contacts 322 provided on the second end 312 of the flexible circuit cable 3 are respectively soldered and connected to the cable contacts 361 of the extension circuit cable 36. In the instant embodiment, the flexible circuit cable 3 may serve as a circuit adaption board in practical applications.

Figure 15:
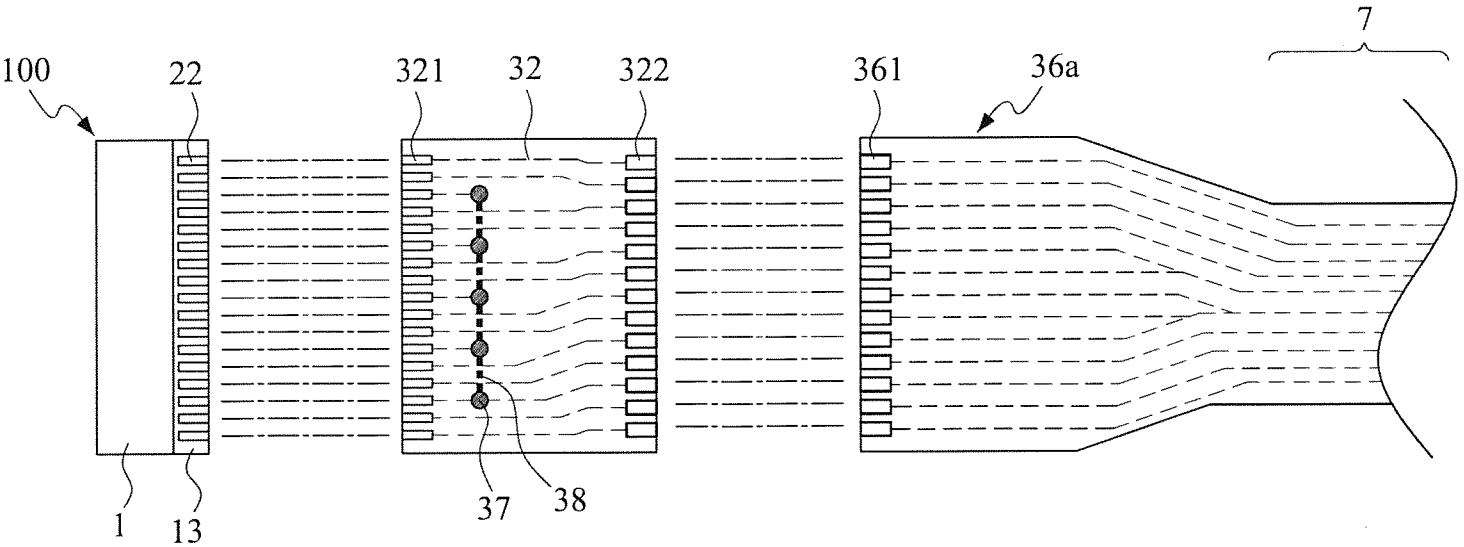
FIG. 15 is a schematic view showing a fifth embodiment according to the present invention.

In the embodiment of FIG. 12, the number and width of the second finger pad conductive contacts 322 provided on the second end 312 of the flexible circuit cable 3 are generally identical to those of the cable contacts 361 of the extension circuit cable 36. However, variations can be made on such a basic arrangement according to the present invention. For example, FIG. 15 shows a schematic view of a fifth embodiment according to the present invention, in which the number of the second finger pad conductive contacts 322 of the second end 312 of the flexible circuit cable 3 is less than that of the first finger pad conductive contacts 321 of the first end 311, but the second end 312 and the first end 311 are set to be of identical width, whereby the pitch or spacing distance between the contacts of the second end 312 is widened. To achieve such an arrangement, via holes 37 and connection lines 38 are arranged in the flexible circuit cable 3 to allow some of the first finger pad conductive contacts 321 of the first end 311 to connected the via holes 37 and the connection lines 38 to a selected common contact of the second end 312 (such as grounding terminal). This simplifies soldering operation carried out between each cable contact 361 of the extension circuit cable 36 and each second finger pad conductive contact 322 of the second end 312 of the flexible circuit cable 3.

Figure 16:
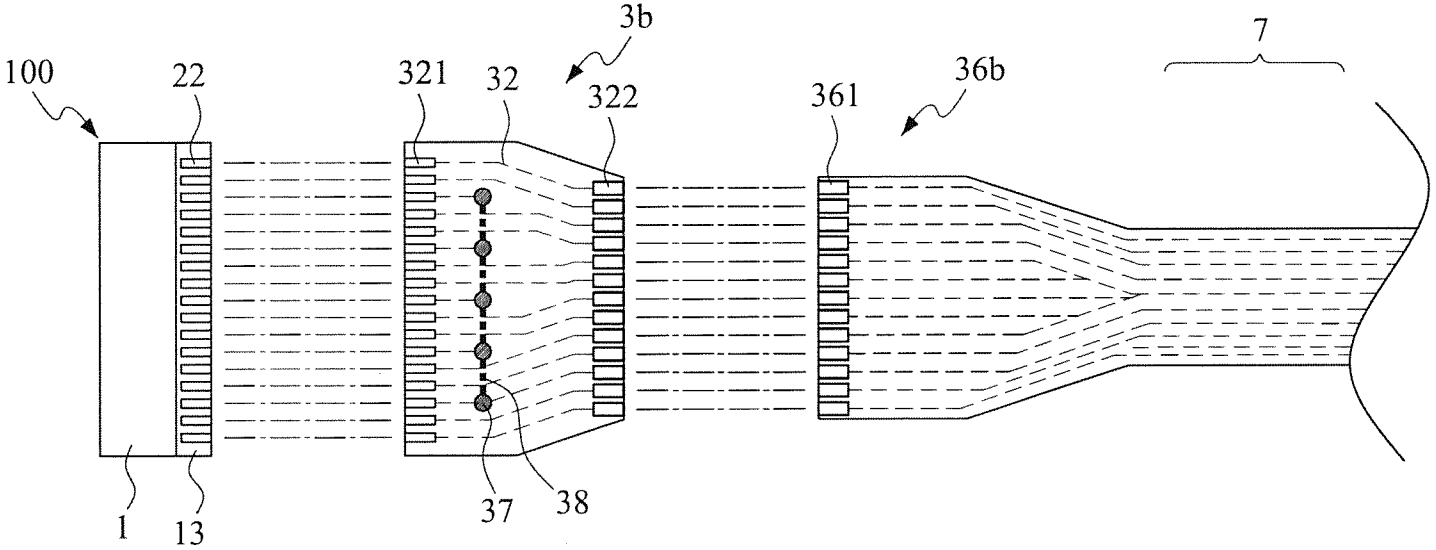
FIG. 16 is a schematic view showing a sixth embodiment according to the present invention.

Further, FIG. 16 shows a schematic view of a sixth embodiment according to the present invention, in which the number of the second finger pad conductive contacts 322 at the second end 312 of the flexible circuit cable 3 is less than that of the first finger pad conductive contacts 321 at the first end 311 and the width of the second end 312 is smaller than the first end 311. To achieve such an arrangement, the same structure constituted by via holes 37 and connection lines 38 can be used. The width of the extension circuit cable 36 can thus be made smaller, which, together with slit lines formed in extension circuit cable 36 and corresponding bundling structure, facilitates passage through a bore of a hinge or a narrow hole.

The present invention provides the following advantages:

(1) The present invention uses a soldering layer to bond a flexible circuit cable to a soldering section of a connector so as to securely fix conductive lines of the flexible circuit cable to the connector, achieving a function of ensuring high stability of signal transmission.

(2) The present invention provides a shielding layer on at least a surface of the flexible circuit cable to realize improved functions of electromagnetic shielding and elimination of electrostatic discharge (ESD).

(3) The shielding layer comprises at least one opening structure, and impedance control of the conductive lines can be realized through selection of size, location, and distribution of the opening structure.

(4) The present invention uses a bundled insertion connection structure of flexible circuit cable for line lay out arrangement through a hinge of electronic device.

(5) The present invention provides an insertion connection structure of flexible circuit cable, which has a simple structure and reduces the manufacturing cost.

(6) The present invention provides an insertion connection structure of flexible circuit cable, in which the numbers of finger pad conductive contacts arranged at first and second ends of the flexible circuit cable can be different or identical and the widths thereof can be different or identical to suit for different requirements of applications.

(7) The present invention provides an insertion connection structure of flexible circuit cable, in which the flexible circuit cable is connected to an extension circuit cable that is selectively provided with slit lines and bundling structure to facilitate passage through a bore of a hinge or a narrow hole.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A connection structure for a flexible circuit cable, comprising:

a connector, which comprises:

a connector housing, which comprises an insertion port and a flexible circuit cable connection port corresponding to the insertion port and forms a soldering stage at the flexible circuit cable connection port;

a plurality of metal conductive terminals, which is arranged on the soldering stage of the flexible circuit cable connection port of the connector housing to be spaced from each other by a predetermined spacing distance, each of the metal conductive terminals comprising:

a connection section, which extends through the connector housing;

a cable soldering section, which extends from an end of the connection section to be located on the soldering stage of the flexible circuit cable connection port of the connector housing; and an insertion section, which extends from an opposite end of the connection section to be located on the insertion port of the connector housing;

a flexible circuit cable, which comprises:

a flexible circuit substrate, which extends in an extension direction and comprises a first end and a second end, the first end being bonded to the soldering stage of the connector housing;

a plurality of parallel conductive lines, which is arranged on the flexible circuit substrate in the extension direction and extends to the first end of the flexible circuit substrate to form a plurality of first finger pad conductive contacts;

an insulation layer, which is formed on the flexible circuit substrate to cover the conductive lines but not covering the first finger pad conductive contacts; and a first metal coating layer, which is formed on at least a portion of a surface of the first finger pad conductive contacts;

a plurality of soldering layers, each of which is bonded between the first metal coating layer of each of the first finger pad conductive contacts and the cable soldering section of the corresponding the metal conductive terminals through soldering at a predetermined soldering temperature to have each of the conductive lines of the flexible circuit cable set in electrical connection with the corresponding metal conductive terminal of the connector.

2. The connection structure as claimed in claim 1, wherein the soldering layer is selected from a group consisting of solder paste and conductive adhesive.

3. The connection structure as claimed in claim 1, wherein the predetermined soldering temperatures is between 120° C.-180° C.

4. The connection structure as claimed in claim 1, wherein the flexible circuit cable comprises at least one shielding layer.

5. The connection structure as claimed in claim 4, wherein the shielding layer comprises at least one opening structure.

6. The connection structure as claimed in claim 1, wherein the flexible circuit cable forms at least one slit line in the extension direction between the first end and the second end.

7. The connection structure as claimed in claim 6, wherein the flexible circuit cable is extendable through a bore of a hinge or a narrow hole.

8. The connection structure as claimed in claim 6, wherein the flexible circuit cable comprises at least one bundling section.

9. The connection structure as claimed in claim 8, wherein the flexible circuit cable comprises a wrapping member that wraps around the bundling section.

10. The connection structure as claimed in claim 1, wherein the soldering stage of the connector is formed on the flexible circuit cable connection port of the connector housing in a horizontal direction and the insertion port is formed on the connector housing in a vertical direction.

11. The connection structure as claimed in claim 1, wherein the conductive lines extend in the extension direction to the second end of the flexible circuit substrate to form at least one connection zone.

12. The connection structure as claimed in claim 1, wherein the plurality of parallel conductive lines of the flexible circuit cable comprise at least one group of differential mode signal lines for transmission of differential mode signals, wherein each group of differential mode signal lines comprises a first differential mode signal line, a second differential mode signal line, and a grounding line.

13. The connection structure as claimed in claim 1, wherein the conductive lines extend from the first end to the second end to form a plurality of second finger pad conductive contacts at the second end, the second finger pad conductive contacts being not covered by the insulation layer.

14. The connection structure as claimed in claim 13, wherein the second finger pad conductive contacts are of a number that is identical to that of the first finger pad conductive contacts.

15. The connection structure as claimed in claim 13, wherein the second finger pad conductive contacts are of a number that is greater than that of the first finger pad conductive contacts.

16. The connection structure as claimed in claim 13, wherein the second finger pad conductive contacts are of a number that is smaller than that of the first finger pad conductive contacts.

17. The connection structure as claimed in claim 13, wherein the second finger pad conductive contacts of the second end are soldered to cable contacts of an extension circuit cable.

* * * * *